US009976494B2

(12) United States Patent
Paul et al.

(10) Patent No.: US 9,976,494 B2
(45) **Date of Patent: *May 22, 2018**

(54) INTERNAL COMBUSTION ENGINE

(71) Applicant: Dr. Ing. h.c. F. Porsche Aktiengesellschaft, Stuttgart (DE)

(72) Inventors: Michael Paul, Weissach (DE); Marco Klampfl, Moensheim (DE); Frank Ickinger, Pleidelsheim (DE)

(73) Assignee: DR. ING. H.C.F. PORSCHE AKTIENGESELLSCHAFT, Stuttgart (DE)

( * ) Notice: Subject to any disclaimer, the term of this patent is extended or adjusted under 35 U.S.C. 154(b) by 11 days.

This patent is subject to a terminal disclaimer.

(21) Appl. No.: 15/075,533

(22) Filed: Mar. 21, 2016

(65) Prior Publication Data

US 2016/0281614 A1 Sep. 29, 2016

(30) Foreign Application Priority Data

Mar. 27, 2015 (DE) ..... 10 2015 104 762

(51) Int. Cl.
*F02D 15/02* (2006.01)

(52) U.S. Cl.
CPC ..... *F02D 15/02* (2013.01)

(58) Field of Classification Search
CPC ..... F02D 15/02; F02D 15/00; F02D 2700/03
See application file for complete search history.

(56) References Cited

U.S. PATENT DOCUMENTS

| | | | |
|---|---|---|---|
| 2,989,954 | A | 6/1961 | Hulbert |
| 5,960,750 | A | 10/1999 | Kreuter |
| 6,595,186 | B2 | 7/2003 | Hiyoshi |

(Continued)

FOREIGN PATENT DOCUMENTS

| | | |
|---|---|---|
| DE | 10 2010 016 037 | 9/2011 |
| DE | 10 2012 112 461 | 6/2014 |

(Continued)

OTHER PUBLICATIONS

German Search Report dated Oct. 6, 2015.
German Office Action dated Jan. 24, 2017.
British Search Report dated Sep. 19, 2016.

*Primary Examiner* — Kevin A Lathers
(74) *Attorney, Agent, or Firm* — Gerald E. Hespos; Michael J. Porco; Matthew T. Hespos

(57) ABSTRACT

An internal combustion engine with an adjustable compression ratio has connecting rods (1), each of which has a hydraulically adjustable eccentric adjustment device arranged in a connecting rod bearing eye (2) and/or in a crankpin bearing eye (3) for adjusting an effective connecting rod length ($l_{eff}$) of the respective connecting rod (1). Travel of the eccentric adjustment device is controlled by a switchover valve (10). Each switchover valve (10) has a pick-off means (14). The switchover valves (10) can be actuated by an actuation device (15) that has a switching fork (16) for each switchover valve (10) and thus for each pick-off means (14) to be actuated. The pick-off means (14) and the switching forks (16) are oriented relative to one another so that inertial forces acting during driving assist the actuation of the switchover valves (10) by the actuation device (15).

7 Claims, 4 Drawing Sheets

(56) References Cited

U.S. PATENT DOCUMENTS

| | | | | |
|---|---|---|---|---|
| 7,059,280 | B2 * | 6/2006 | Nohara | F02D 15/02 123/48 D |
| 7,066,118 | B2 * | 6/2006 | Hirano | F02D 15/02 123/48 B |
| 2003/0051685 | A1 | 3/2003 | Hiyoshi | |
| 2015/0260109 | A1 | 9/2015 | Wittek | |
| 2016/0245331 | A1 | 8/2016 | Schaffrath et al. | |

FOREIGN PATENT DOCUMENTS

| | | | |
|---|---|---|---|
| DE | 10 2013 210 494 | | 12/2014 |
| DE | 102014118728 | A1 | 12/2014 |
| EP | 1293659 | A2 | 3/2003 |
| WO | 2014/019683 | | 2/2014 |
| WO | 2014/019684 | | 2/2014 |
| WO | 2015082722 | A2 | 6/2015 |
| WO | 2015193427 | A1 | 12/2015 |
| WO | 2016026487 | A1 | 2/2016 |

* cited by examiner

INTERNAL COMBUSTION ENGINE

CROSS REFERENCE TO RELATED APPLICATION

This application claims priority under 35 USC 119 to German Patent Appl. No. 10 2015 104 762.4 filed on Mar. 27, 2015, the entire disclosure of which is incorporated herein by reference.

BACKGROUND

1. Field of the Invention

The invention relates to an internal combustion engine with variable compression ratio.

2. Description of the Related Art

In internal combustion engines, a high compression ratio has a positive effect on efficiency. The compression ratio is to be understood to mean the ratio of the entire cylinder chamber before the compression with respect to the remaining cylinder chamber after the compression.

Internal combustion engines with applied ignition, such as Otto-cycle engines, generally have a fixed compression ratio. The compression ratio can only be selected to be so high that so-called "knocking" is avoided during full-load operation. However, for the much more commonly encountered part-load range of the internal combustion engine, that is to say in the case of a small cylinder charge, it would be possible for the compression ratio to be selected to have higher values without "knocking" occurring. The important part-load range of an internal combustion engine can be improved if the compression ratio of the internal combustion engine is variably adjustable.

DE 10 2010 016 037 A1 discloses an internal combustion engine with an adjustable compression ratio, and FIG. 1 herein shows a known connecting rod 1 for such an internal combustion engine. The connecting rod 1 of FIG. 1 has a crankpin bearing eye 3 for connecting the connecting rod 1 to a crankshaft and a connecting rod bearing eye 2 for connecting the connecting rod 1 to a cylinder piston of the internal combustion engine. Each connecting rod 1 has an eccentric adjustment device 9 that includes an eccentric body 4, an eccentric lever 5 and eccentric rods 6.

The eccentric body 4 has a piston pin bore that is arranged eccentrically with respect to a central point of the connecting rod bearing eye 2 and that has a central point. The piston pin bore receives a piston pin. The eccentric adjustment device 9 functions to adjust an effective connecting rod length $l_{eff}$, which is defined as the distance between the central point of the piston pin bore and a central point of the crankpin bearing eye 3. The eccentric rods 6 of the eccentric adjustment device 9 are displaceable for rotation of the eccentric body 4, and thus for varying the effective connecting rod length $l_{eff}$. Each eccentric rod 6 is assigned a piston that is guided displaceably in a hydraulic chamber. A hydraulic pressure prevails in the hydraulic chambers and acts on the pistons assigned to the eccentric rods. Displacement of the eccentric rods 6 is possible, or is not possible, depending on the amount of oil in the hydraulic chambers.

The adjustment of the eccentric adjustment device is initiated by action of inertial and load forces of the internal combustion engine on the eccentric adjustment device during a working stroke of the internal combustion engine. The directions of the forces on the eccentric adjustment device vary continuously during a working stroke. The adjustment movement is assisted by the pistons that are acted on with hydraulic oil and that act on the eccentric rods 6. The pistons prevent a restoring movement of the eccentric adjustment device 9 as a result of varying directions of force action of the forces acting on the eccentric adjustment device 9. The eccentric rods 6, which interact with the pistons, are connected to the eccentric body 4 via the eccentric lever 5.

The hydraulic chambers in which the pistons are guided can be charged or filled with hydraulic oil via hydraulic oil feed lines from the crankpin bearing eye 3. Check valves prevent a return flow of the hydraulic oil from the hydraulic chambers back into the hydraulic oil feed lines. A switchover valve 10 is received in a bore of the respective connecting rod 1. The hydraulic chambers are in contact, via hydraulic oil discharge lines, with the bore that receives the switchover valve 10. The switching position of the switchover valve 10 determines which of the hydraulic chambers is filled with hydraulic oil and which of the hydraulic chambers is evacuated. The adjustment direction or direction of rotation of the eccentric adjustment device 9 is dependent on this.

The switchover valve known from DE 10 2010 016 037 A1 comprises an actuation element, a restoring spring and a control piston.

As noted above, the hydraulic oil that acts on the pistons in the hydraulic chambers of the eccentric rods 6 is fed to the hydraulic chambers from the crankpin bearing eye 3 via the hydraulic oil feed lines. The respective connecting rod 1 engages by way of the crankpin bearing eye 3 on the crankshaft so that a connecting rod bearing shell is arranged between a crankshaft bearing journal of the crankshaft and the crankpin bearing eye.

The hydraulic chambers can be ventilated via the hydraulic oil discharge lines in accordance with the switching position of the switchover valve 10 to determine the adjustment direction or direction of rotation of the eccentric adjustment device 9.

DE 10 2012 112 461 A1 describes a further internal combustion engine with an adjustable compression ratio and with connecting rods that have variably adjustable connecting rod lengths. Again, a switchover valve is received in a bore of the respective connecting rod and comprises a pick-off means or actuatable element. The respective switchover valve can be actuated via an actuation device that engages on the pick-off means.

WO 2014/019684 A1 describes a further internal combustion engine with an adjustable compression ratio where the connecting rod length of the connecting rods is variably adjustable. Switchover valves are actuable by an actuation device that has switching forks.

It is an object of the invention to provide an internal combustion engine with an adjustable compression ratio and with improved actuation of the switchover valves.

SUMMARY

The invention relates to an internal combustion engine with an adjustable compression ratio and with switchover valves. The pick-off means or actuatable elements of the switchover valves and the switching forks of the actuating device are oriented relative to one another such that inertial forces acting during driving operation assist the actuation of the switchover valves by the actuating device. In this way, the actuation of the switchover valves is improved. Lower actuation forces are required for the actuating device and thus switchover valves because the actuation is assisted by inertial forces that act during an acceleration and deceleration of the motor vehicle.

When the switchover valves assume a switching position for part-load operation of the internal combustion engine, the actuatable elements of the switchover valves are oriented so that inertial forces acting during an acceleration of the motor vehicle cause a relative movement between the switching forks of the actuating device and the pick-off means of the switchover valves. This relative movement assists a transfer of the switchover valves into a switching position for full-load operation of the internal combustion engine. When the switchover valves assume a switching position for full-load operation of the internal combustion engine, the actuatable elements of the switchover valves are oriented so that inertial forces that act during a deceleration of the motor vehicle cause a relative movement between the switching forks of the actuating device and the actuatable element of the switchover valves. This relative movement assists a transfer of the switchover valves into a switching position for part-load operation of the internal combustion engine, thereby improving actuation of the switchover valves.

In one embodiment, the actuatable elements of the switchover valves may protrude forward, as viewed in the forward direction of travel, in relation to a connecting rod main body when the switchover valves assume the switching position for part-load operation of the internal combustion engine. On the other hand, the actuatable elements of the switchover valves protrude rearward, as viewed in the forward direction of travel, in relation to a connecting rod main body when the switchover valves assume the switching position for full-load operation of the internal combustion engine.

A front switching fork section of the switching forks can be placed in abutment against a section that protrudes forward in relation to a connecting rod main body of the actuatable element of the switchover valves as a result of the inertial forces that act during an acceleration of the motor vehicle. On the other hand, a rear switching fork section of the switching forks can be placed in abutment against a section that protrudes rearward in relation to a connecting rod main body of the actuatable element as a result of the inertial forces that act during a deceleration of the motor vehicle.

Exemplary embodiments of the invention will be discussed in more detail on the basis of the drawings, without the invention being restricted to those embodiments.

DETAILED DESCRIPTION

Figure 1:
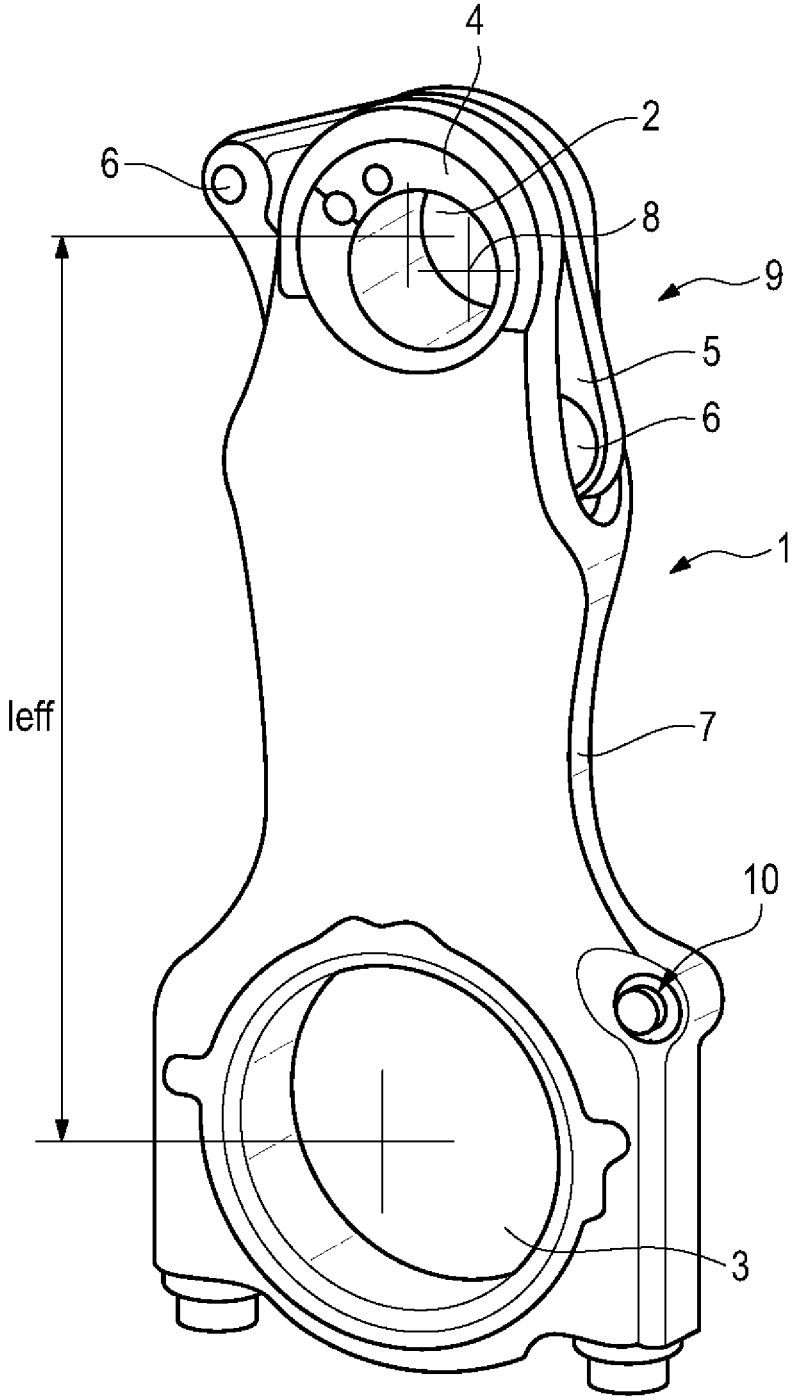
Fig. 1 (Prior art)
FIG. 1 shows a prior art connecting rod of an internal combustion engine with variable compression ratio.

FIG. 1 schematically shows a connecting rod 1 of an internal combustion engine with adjustable compression ratio. The connecting rod 1 has a connecting rod main body 7 with a connecting rod bearing eye 2 and a crankpin bearing eye 3.

The connecting rod bearing eye 2 functions to connect of the respective connecting rod 1 to a cylinder piston 11 of a respective cylinder of the internal combustion engine. The crankpin bearing eye 3 functions to connect of the respective connecting rod 1 to a crankshaft 12 of an internal combustion engine 13 (see FIGS. 2 and 3).

The connecting rod 1 of FIG. 1 has a hydraulically adjustable eccentric adjustment device 9 that is arranged, at least in sections, in the connecting rod bearing eye 2. The eccentric adjustment device 9 has an eccentric body 4 with a piston pin bore that is arranged eccentrically with respect to a central axis 8 of the connecting rod bearing eye 2 and that has a central axis. The piston pin bore receives a piston pin (not shown). The respective connecting rod 1 is coupled by way of the piston pin to the cylinder piston 11 of the respective cylinder.

The eccentric adjustment device 9 is operative to adjust an effective connecting rod length $l_{eff}$ of the connecting rod 1.

A rotation of the adjustable eccentric adjustment device 9 is initiated by action of inertial and load forces of the internal combustion engine that act on the eccentric adjustment device 9 during a working stroke of the internal combustion engine. During a working stroke, the directions of action of the forces acting on the eccentric adjustment device 9 continuously vary. The rotational movement or adjustment movement is assisted by pistons that are acted on with hydraulic fluid, in particular with engine oil. The pistons are integrated in the connecting rod 1 and are guided in hydraulic chambers. Additionally, the pistons prevent a restoring movement of the eccentric adjustment device 9 as a result of varying directions of forces acting on the eccentric adjustment device 9.

The pistons of the eccentric adjustment device 9 are connected operatively by way of eccentric rods 6 and by way of an eccentric lever 52 to an eccentric body 4 of the eccentric adjustment device 9. The pistons of the eccentric adjustment device 9 are charged with hydraulic fluid from the crankpin bearing eye 3 via hydraulic fluid lines (not shown in FIG. 1) and via check valves (not shown). The check valves prevent a return flow of the hydraulic fluid from the piston volumes of the pistons back into the hydraulic fluid lines and into an engine interior of the internal combustion engine.

A switchover valve 10 is received in a bore of the respective connecting rod 1. The hydraulic chambers of the eccentric adjustment device 9 of the respective connecting rod 1 are in contact, via hydraulic fluid lines, with the bore that receives the switchover valve 10. The switching position of the switchover valve 10 determines which of the hydraulic chambers is filled with hydraulic oil and which of the hydraulic chambers is evacuated and hence determines the adjustment direction or direction of rotation of the eccentric adjustment device 9.

The respective switchover valve 10 of the respective connecting rod 1 has a pick-off means or actuatable element 14. The respective switchover valve 10 can be actuated by way of an actuating device 15 that engages on the actuatable element 14.

Details of the switchover valve 10 of the respective connecting rod 1 and of the actuatable element 14 of the respective switchover valve 10 are familiar to a person of relevant skill in the art for example from DE 10 2012 112 461 A1.

As shown in FIG. 1, the eccentric lever 5 of the eccentric adjustment device 9 is guided in a slot of the connecting rod bearing eye 2. By contrast, it is also possible, as shown for example in FIG. 5, for the eccentric lever 5 to have two eccentric lever segments 5*a*, 5*b* that are positioned in front of and behind the connecting rod bearing eye 2 and that are connected fixedly to the eccentric body 4.

The actuating device 15 (see FIG. 4) is configured to actuate multiple switchover valves 10 of the internal combustion engine 13, and has multiple switching forks 16. Each of the switching forks 16 interacts with a actuatable element 14 of, in each case, one switchover valve 10 for actuation.

Figure 4:
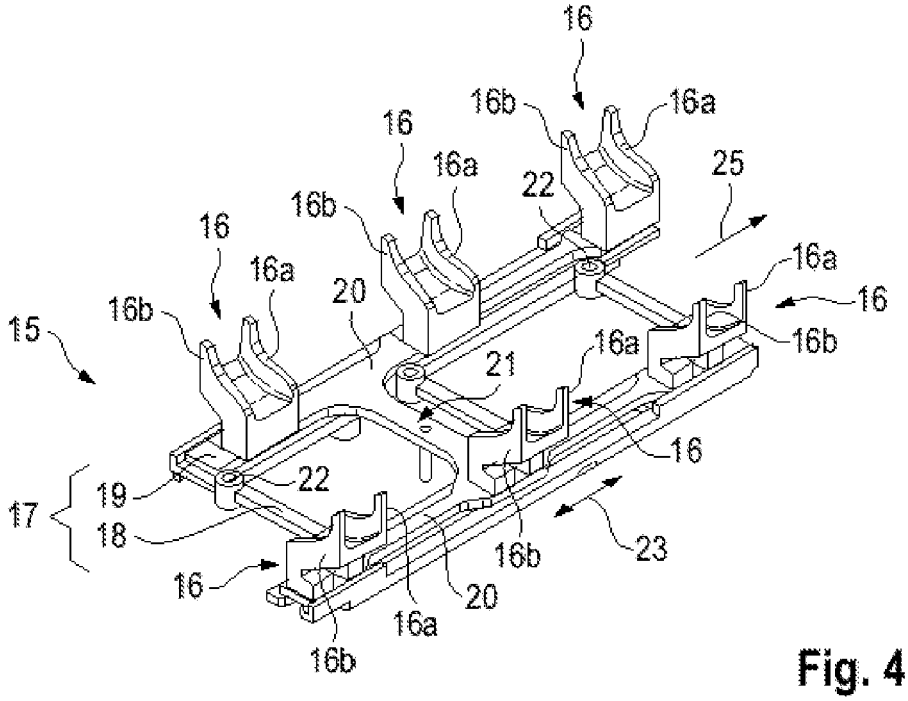
FIG. 4 shows an actuation device of the internal combustion engine of FIG. 3.

The actuating device 15 shown in FIG. 4 is configured so that all of the switching forks 16 are fastened to a common supporting structure 17. The supporting structure 17 comprises an installation frame 18 and a guide element 19 that is displaceable relative to the installation frame 18. The guide element 19 has two guide rails 20 that run parallel to one another and that are connected fixedly to one another by way of a connecting web 21. Multiple switching forks 16 are fastened to each guide rail 20 of the guide element 19. The installation frame 18 enables the entire actuating device 15 to be installed on the crankcase of the internal combustion engine 13, specifically by way of installation screws (not shown) that extend through installation openings 22 in the installation frame 18.

The guide element 19 of the actuating device 15, to which the switching forks 16 are fastened, is displaceable relative to the installation frame 18 in the direction of the double arrow 23 shown in FIG. 4.

This movement of the switching forks 16 of the actuating device 15 relative to the installation frame 18 makes it possible for the actuatable element 14 of the respective switchover valve 10 to actuate the switchover valve 10, when the switchover valve 10 of the respective cylinder has moved into the region of the respective switching fork 16 of the actuation device 1 during a working stroke of a cylinder.

The invention relates to details of an internal combustion engine that permits particularly advantageous actuation of the switchover valves 10 of the connecting rods 1 by way of the actuating device 15.

As stated above, each connecting rod 1 of an internal combustion engine 13 comprises a switchover valve 10. Each switchover valve 10 has a actuatable element 14 that can be actuated by the actuating device 15. A switching fork 16 of the actuating device 15 acts with each pick-off means 14 and then with each switchover valve 10. Accordingly, each connecting rod 1, each switchover valve 10 and each actuatable element 14 has a separate switching fork 16 for the actuation of the respective switchover valve 10.

According to the invention, the actuatable elements 14 of the switchover valves 10 and the switching forks 16 of the actuating device 15 are oriented relative to one another such that inertial forces that act on the actuating device 15 during a driving operation assist the actuation of the switchover valves 10 by way of the actuating device 15.

Figure 2:
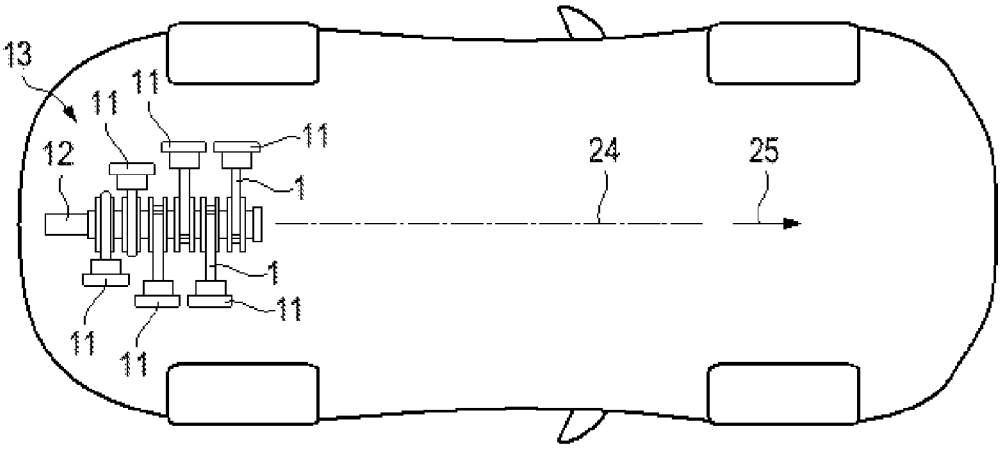
FIG. 2 shows a motor vehicle having an internal combustion engine according to the invention.
Figure 3:
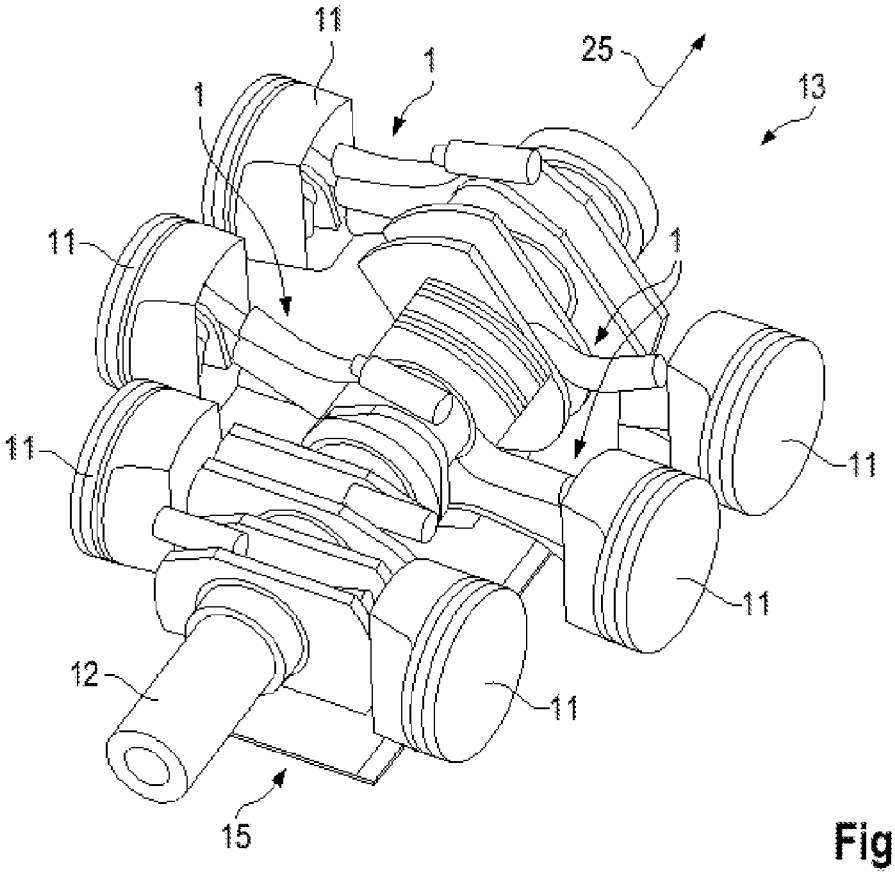
FIG. 3 shows the internal combustion engine of FIG. 2 in a perspective view.

As can be seen from FIG. 2, the internal combustion engine 13 is installed in the motor vehicle such that the crankshaft 12 extends in the direction of a longitudinal central axis 24 of the motor vehicle. A forward direction of travel of the motor vehicle is illustrated in FIG. 2 by an arrow 25.

The orientation of the actuatable elements 14 of the switchover valves 10 and of the switching forks 16 of the actuating device 15 is selected so that, when the switchover valves 10 of the connecting rods 1 of the internal combustion engine 13 assume a switching position for part-load operation of the internal combustion engine 13, the actuatable element 14 of the switchover valves 10 are oriented so that inertial forces acting on the actuating device 15 during an acceleration of the motor vehicle cause a relative movement between the switching forks 16 of the actuating device 15 and the actuatable elements 14 of the switchover valves 10. This relative movement assists a transfer of the switchover valves 10 into the switching position for full-load operation of the internal combustion engine 13.

By contrast, when the switchover valves 10 of the connecting rods 1 assume the switching position for full-load operation of the internal combustion engine 13, the actuatable elements 14 of the switchover valves 10 of the connecting rods 1 of the internal combustion engine 13 are oriented so that inertial forces that act on the actuating device 15 during a deceleration of the motor vehicle cause a relative movement between the switching forks 16 of the actuating device 15 and the actuatable element 14 of the switchover valves 10. This relative movement assists a transfer of the switchover valves 10 into the switching position for part-load operation of the internal combustion engine 13.

When the switchover valves 10 of the connecting rods 1 assume a switching position for part-load operation of the internal combustion engine, the actuatable elements 14 of the switchover valves 10 of all of the connecting rods 1 protrude forward, as viewed in the forward direction of travel 25, in relation to the main body 7 of the respective connecting rod 1. Then, as a result of inertial forces that act on the actuating device 15 during an acceleration of the motor vehicle, front switching fork sections 16*a* of the switching forks 16 abut against that section of the actuatable element 14 of the switchover valves 10 that protrudes forward in relation to the connecting rod main body 7 of the connecting rods 1.

When the switchover valves 10 of the connecting rods 1 assume the switching position for full-load operation of the internal combustion engine 10, the actuatable elements 14 of the switchover valves 10 protrude rearward, as viewed in the forward direction of travel 25, in relation to the connecting rod main body 7 of the connecting rods 1. When, in this state, the motor vehicle decelerates, the inertial forces that act on the actuating device 15 during the deceleration cause rear switching fork sections 16*b* of the switching forks 16 to abut against that section of the actuatable elements 14 of the switchover valves 10 that protrudes rearward in relation to the respective connecting rod main body 7.

Figure 5:
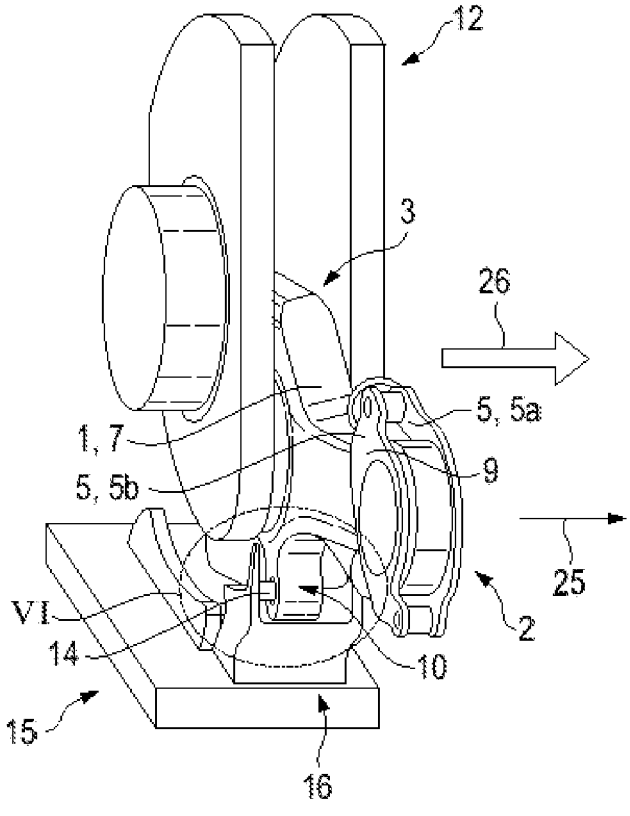
FIG. 5 shows a detail of the internal combustion engine of FIG. 3.
Figure 6:
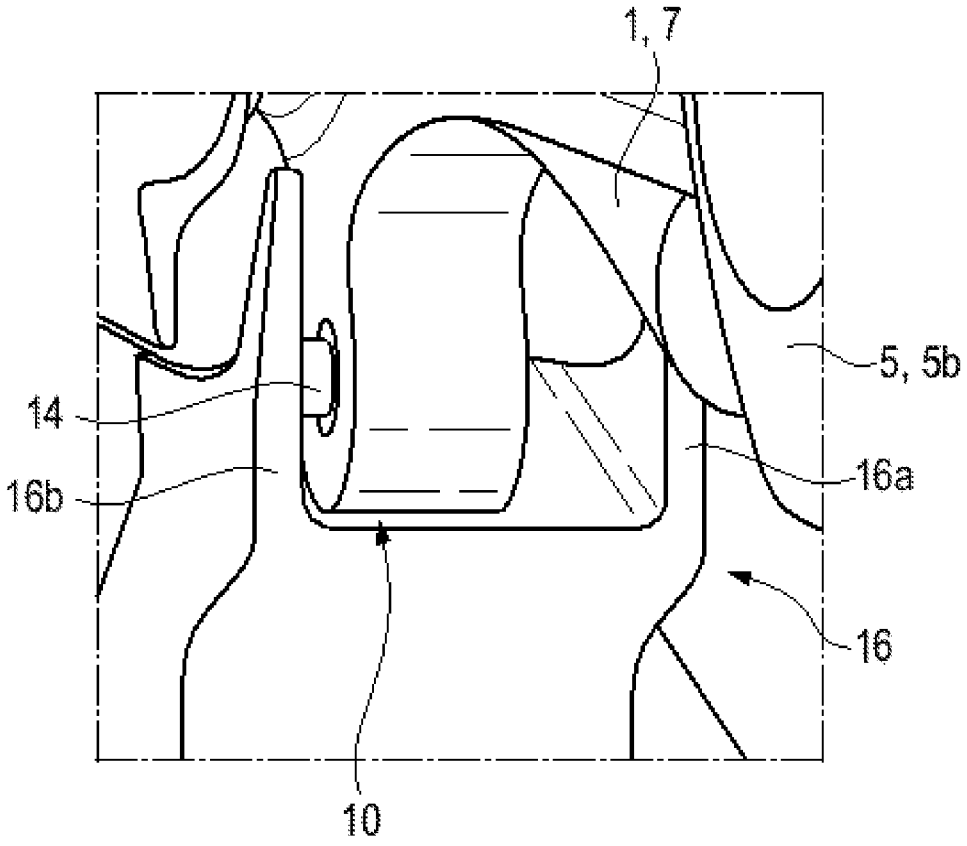
FIG. 6 shows the detail VI of FIG. 5.

FIG. 5 shows a detail of a connecting rod 1 of the internal combustion engine 13 and of a switching fork 16 of the actuating device 15 that interacts with the switchover valve 10 of said connecting rod 1. FIG. 6 shows an enlarged detail of FIG. 5.

In FIGS. 5 and 6, the actuatable element 14 of the switchover valve 10 shown therein protrudes rearward in relation to the connecting rod main body 7 as viewed in the forward direction of travel 25. The switchover valve 10 has accordingly assumed the switching position for full-load operation. When the motor vehicle decelerates, an inertial force acts on the actuating device 15 in the direction of the arrow 26 in FIG. 5. As a result, the switching fork 16 is moved relative to the actuatable element 14 in the direction of the arrow 26 so that the rear switching fork section 16*b* of the switching fork 16 abuts against the actuatable element 14 and assists the transfer of the switchover valve 10 from the switching position for full-load operation into the switching position for part-load operation.

According to the invention, the internal combustion engine utilizes inertial forces that act on the actuating device 15 during acceleration and deceleration of the motor vehicle for actuation of the switchover valves 10 of the internal combustion engine 13. Inertial forces that act during acceleration assist the transfer of the switchover valves 10 from the part-load position into the full-load position. Inertial forces that act during a deceleration of the motor vehicle assist the switchover of the switchover valves 10 from the full-load position into the part-load position. A particularly advantageous changeover of the internal combustion engine from part-load operation into full-load operation and from full-load operation into part-load operation is possible in this way.

What is claimed is:

1. An internal combustion engine for a motor vehicle, the internal combustion engine having an adjustable compression ratio and comprising multiple connecting rods, each of the connecting rods having a hydraulically adjustable eccentric adjustment device arranged in a connecting rod bearing eye and/or in a crankpin bearing eye for adjusting an effective connecting rod length ($l_{eff}$) of the respective connecting rod, each of the eccentric adjustment devices having a switchover valve for controlling an adjustment travel of the eccentric adjustment device, each of the switchover valves having an actuatable element, an actuating device configured for actuating the switchover valves, the actuating device having a switching fork for each of the switchover valves and for each of the actuatable elements to be actuated, the actuatable elements of the switchover valves and the switching forks of the actuating device are oriented relative to one another such that inertial forces acting during driving of the motor vehicle assist the actuation of the switchover valves by the actuating device.

2. The internal combustion engine of claim 1, wherein, when the switchover valves assume a switching position for part-load operation of the internal combustion engine, the actuatable elements of the switchover valves are oriented so that inertial forces acting during an acceleration of the motor vehicle cause a relative movement between the switching forks of the actuating device and the actuatable elements of the switchover valves that assists a transfer of the switchover valves into a switching position for full-load operation of the internal combustion engine.

3. The internal combustion engine of claim 2, wherein, when the switchover valves assume the switching position for part-load operation of the internal combustion engine, the actuatable elements of the switchover valves protrude forward in a forward direction of travel of the motor vehicle, in relation to a connecting rod main body.

4. The internal combustion engine of claim 3, wherein inertial forces that act during acceleration of the motor vehicle cause a front switching fork section of the switching forks to abut against a section that protrudes forward in relation to a connecting rod main body of the actuatable elements of the switchover valves.

5. The internal combustion engine of claim 1, wherein when the switchover valves assume a switching position for full-load operation of the internal combustion engine, the actuatable elements of the switchover valves are oriented so that inertial forces that act during deceleration of the motor vehicle cause a relative movement between the switching forks of the actuating device and the actuatable elements of the switchover valves to assist a transfer of the switchover valves into a switching position for part-load operation of the internal combustion engine.

6. The internal combustion engine of claim 5, wherein, when the switchover valves assume the switching position for full-load operation of the internal combustion engine, the actuatable elements of the switchover valves protrude rearward, as viewed in a forward direction of travel, in relation to a connecting rod main body.

7. The internal combustion engine of claim 6, wherein inertial forces that act during a deceleration of the motor vehicle cause a rear switching fork section of the switching forks to abut against a section that protrudes rearward in relation to a connecting rod main body of the actuatable elements of the switchover valves.

* * * * *